United States Patent [19]

Ploog et al.

[11] 4,384,978

[45] May 24, 1983

[54] AQUEOUS CONCENTRATES OF A TENSIDE OF THE SULFATE AND SULFONATE TYPE AND PROCESS FOR THE IMPROVEMENT OF THE FLOW BEHAVIOR OF DIFFICULTLY POURABLE AQUEOUS TENSIDE CONCENTRATES

[75] Inventors: Uwe Ploog, Haan; Ingo Wegener, Dusseldorf; Johann Glasl, Solingen; Werner Erwied, Langenfeld; Bernhard Bartnick, Monheim-Baumberg; Rainer Höfer, Dusseldorf, all of Fed. Rep. of Germany

[73] Assignee: Henkel Kommanditgesellschaft auf Aktien, Dusseldorf-Holthausen, Fed. Rep. of Germany

[21] Appl. No.: 181,639

[22] Filed: Aug. 26, 1980

[30] Foreign Application Priority Data

Sep. 1, 1979 [DE] Fed. Rep. of Germany ..... 2935428
Jan. 29, 1980 [DE] Fed. Rep. of Germany ..... 3002993

[51] Int. Cl.[3] ..... B01F 17/04
[52] U.S. Cl. ..... 252/353; 252/355
[58] Field of Search ..... 252/353, 354, 355; 524/156

[56] References Cited

U.S. PATENT DOCUMENTS

| | | | |
|---|---|---|---|
| 1,970,578 | 8/1934 | Schoeller | 260/93 |
| 2,758,977 | 8/1956 | Knowles | 252/153 |
| 2,940,936 | 6/1960 | Fike | 252/161 |
| 3,893,955 | 7/1975 | Hewitt | 252/551 |
| 3,899,448 | 8/1975 | Messenger | 252/551 |

FOREIGN PATENT DOCUMENTS

| | | |
|---|---|---|
| 2305554 | 8/1973 | Fed. Rep. of Germany . |
| 2550341 | 5/1976 | Fed. Rep. of Germany . |
| 2501982 | 7/1976 | Fed. Rep. of Germany . |
| 2703998 | 10/1980 | Fed. Rep. of Germany . |
| 2268069 | 11/1975 | France . |
| 1437089 | 5/1976 | United Kingdom . |

*Primary Examiner*—Allan Lieberman
*Assistant Examiner*—Patricia Short
*Attorney, Agent, or Firm*—Hammond & Littell, Weissenberger and Muserlian

[57] ABSTRACT

An aqueous concentrate of a tenside of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates and a viscosity reducing amount of a water-soluble salt of a polyglycol ether sulfate selected from the group consisting of monosulfates of polylower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500; as well as the process of improving the flow behaviour of difficultly pourable aqueous concentrates of at least one tenside of the sulfate and sulfonate type comprising employing as a viscosity reducing compound a water-soluble salt of a mono- or disulfate of a poly-lower alkylene ether glycol.

17 Claims, No Drawings

AQUEOUS CONCENTRATES OF A TENSIDE OF THE SULFATE AND SULFONATE TYPE AND PROCESS FOR THE IMPROVEMENT OF THE FLOW BEHAVIOR OF DIFFICULTLY POURABLE AQUEOUS TENSIDE CONCENTRATES

BACKGROUND OF THE INVENTION

Anionic tensides dominate the field of emulsifying agents in the technical preparation of polymer dispersions. In addition to alkyl sulfates, alkyl polyalkylene ether glycol sulfates and alkyl benzene sulfonates, the main substances used today are mainly alkaryl polyalkylene ether glycol sulfates, and sulfosuccinates of natural and synthetic alcohol polyalkylene ether glycols or alkylphenol ethoxylates.

The preparation of such emulsifying agents is known and is described in detail in the scientific literature and especially also in patent specifications. Reference is made in this respect to Lindner, "Tenside, Textilhilfsmittel, Waschrohstoffe," Stuttgart, Germany, Vol. 1, 1964, especially pages 619–624, 636–643, 673–678 and 768–787; as well as to German Pat. No. DE-PS 834,245; Belgian Pat. No. BE-PS 680,629; U.S. Pat. No. 1,970,578; French Pat. No. FR-PS 1,079,974; U.S. Pat. No. 2,416,254, U.S. Pat. No. 2,489,026, U.S. Pat. No. 2,510,008 and U.S. Pat. No. 2,758,977.

In this context, emulsifying agents of the mentioned type usually are offered commercially in the form of dilute aqueous solutions. Highly concentrated mixtures can be prepared only with the addition of up to 20% of lower alkanols such as ethanol or isopropanol. The presence of organic solvents, for example, the mentioned alcohols, is not always desirable in polymer dispersions, however, for reasons of application technology. In addition, the presence of these alcohols present a considerable safety risk during the preparation of the emulsifying agents as well as during transporting, storage and use. In addition, it is known that even slight shifts in the ratio of water to alcohol can lead to undesirable sedimentation in such concentrates.

In addition thereto, the expert skilled in the art knows that upon the dilution of aqueous tenside concentrates containing no alcohols, the mixture frequently passes through the phase of a thick gel that can no longer be pumped. This leads to considerable difficulties in the operation. For example, it frequently is no simple matter to bring lumps of gel, once they have formed, back into solution. The valves of feeding vessels can be clogged with them and variations in concentration during dosing may occur. Finally, the diluting of such aqueous tenside pastes is a very time-consuming process for the reasons mentioned above.

The preparation of highly concentrated alkyl polyalkylene ether glycol sulfates that can be pumped is also known to present a problem that remains difficult to solve. Alkyl polyalkylene ether glycol sulfates, also called alkyl ether sulfates are especially sulfates of alkoxylated nonaromatic alcohols with 8 to 24 carbon atoms, particularly 8 to 18 carbon atoms. Alcohols of this type can be obtained from naturally occurring starting materials, such as coconut oil or palm oil, or they are synthetic materials, such as known Ziegler alcohols or oxo-alcohols. The nonaromatic alcohols with saturated or unsaturated, optionally also branched, radicals of the mentioned type, are first alkoxylated with lower alkylene oxides, especially with ethylene oxide and/or with propylene oxide, subsequently sulfated and then converted into the respective water-soluble salts. Such products are useful for the preparation of detergents.

Detergents of this type are used for many purposes, for example, in liquid cleaning agents, foam baths and shampoos.

Aqueous solutions with a relatively low content of alkyl ether sulfate, for example, with a content of about 10% by weight of wash-active substance (WAS), exhibit the special property of this class of detergents, that is, of being thickened again by the addition of neutral salts, such as NaCl or $Na_2SO_4$. This ability of the class of detergents in question frequently is made use of in practice.

However, another characteristic with respect to rheological behavior of respective tenside concentrates causes grave problems for practical applications. Highly concentrated aqueous tenside concentrates with a WAS content of 50% by weight or more, for example, have the consistency of a thick gel or a corresponding paste and cannot be pumped. Attempts to thin out this gel with water do not reduce the thickness, as might be expected, but initially result in its increase. It is understandable that this leads to considerable problems for the use of the material.

Several recommendations have been made to overcome these difficulties. For example, The German Published Application DE-OS No. 22 51 405 describes the use of certain salts of carboxylic acids. Particularly the salts of hydroxycarboxylic acids, such as sodium citrate, are recommended. According to DE-OS No. 23 05 554, aromatic sulfonic acids and their salts are suitable for the same purpose. According to DE-OS No. 23 26 006, sulfonic acids or sulfates or the respective water-soluble salts of saturated or unsaturated aliphatic hydrocarbon radicals with 1 to 6 carbon atoms can be used as viscosity regulators. However, all these recommendations limit themselves to the group of linear alkyl polyglycol ether sulfates and their use as detergent tensides.

OBJECTS OF THE INVENTION

An object of the present invention is the obtaining of a free-flow, readily dilutable aqueous concentrate of a tenside of the sulfate and sulfonate type.

Another object of the present invention is the obtaining of an aqueous concentrate of a tenside of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates and a viscosity reducing amount of a water-soluble salt of a polyglycol ether sulfate selected from the group consisting of monosulfates of poly-lower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500.

A further object of the present invention is the development of an improvement in the process for improving the flow behavior of difficultly pourable aqueous concentrates of tensides of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates by mixing therewith a viscosity reducing amount of an organic viscosity reducing compound and recovering an aqueous concentrate having improved flow behavior, the improvement consisting essentially of utilizing a viscosity reducing amount of a water-soluble salt of a polyglycol ether sulfate selected from the group consisting of monosulfates of poly-lower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500, as said organic viscosity reducing compound.

These and other objects of the invention will become more apparent as the description thereof proceeds.

DESCRIPTION OF THE INVENTION

The technical task of the present invention is the development of aqueous concentrates of concentrates of the described sulfate and sulfonate type that can be pumped even in high concentrations, do not show any undesirable increase in viscosity or thickening of the gel phase upon diluting with water and, nevertheless, can be thickened effectively in the dilute state at low tenside concentrations by the addition of neutral salts such as sodium chloride or sodium sulfate, and that are suitable, for example, as detergent tensides, for the production of shampoo, for the emulsifying of natural fats or as emulsifying agents for polymerization without the addition of metal salts. Especially the formation of colloidal gel phases is to be prevented according to the invention.

The technical solution of this task is based on the observation that water-soluble salts of mono- and/or disulfates of poly-lower alkylene ether glycols, particularly of polyethylene glycol and/or polypropylene glycol (here particularly 1,2-polypropylene glycol) are effective viscosity regulators for aqueous tenside concentrates of the type discussed here. Particularly the observation that the effect of these viscosity regulators increases with the increasing molecular weight of the basic polyether glycol sulfate or disulfate was made within the scope of the present invention.

More particularly, the present invention relates to an aqueous concentrate of a tenside of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates and a viscosity reducing amount of a water-soluble salt of a polyglycol ether sulfate selected from the group consisting of monosulfates of poly-lower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500.

In addition, the present invention relates to an improvement in the process for improving the flow behavior of difficulty pourable aqueous concentrates of tensides of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates by mixing therewith a viscosity reducing amount of an organic viscosity reducing compound and recovering an aqueous concentrate having improved flow behavior, the improvement consisting essentially of utilizing a viscosity reducing amount of a water-soluble salt of a polyglycol ether sulfate selected from the group consisting of monosulfates of poly-lower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500, as said organic viscosity reducing compound.

The subject of the invention consequently is, in a first form of execution, aqueous concentrates of tensides containing at least about 20% by weight and preferably about 25% by weight of water-soluble salts of one or several of the following tensides together with small amounts of viscosity regulators: nonaromatic alkoxylated and subsequently sulfated alcohols (ether sulfate salts), alkary polyglycol ether sulfates, alkyl sulfates, alkaryl sulfonates, alkyl polyglycol ether sulfosuccinates, alkaryl polyglycol ether sulfosuccinates and alkyl sulfosuccinates. These tenside concentrates are characterized by the fact that they contain water-soluble salts of monosulfates and/or disulfates of a poly-lower alkylene ether glycol, such as polyethylene ether glycol or polypropylene ether glycol, with a molecular weight for the poly-lower alkylene ether glycol of at least about 600, as viscosity regulators. If desired, nonionic poly-lower alkylene ether glycols with a molecular weight of at least 1,500 may be used together with the water-soluble salts of the mentioned monosulfates and/or disulfates of the poly-lower alkylene ether glycols. The tensides are present preferably in amounts of at least about 25% by weight, preferably in amounts of 50% to 80% by weight, based on the aqueous tenside concentrate. Poly-lower alkylene ether glycols of the type discussed here are derived from straight-chain or branched-chain alkylene glycols with a maximum of 5 carbon atoms.

Of particular importance are the corresponding polyethylene ether glycols and/or polypropylene ether glycols, with special significance attaching to the polyether glycols derived from 1,2-propylene glycol in the case of the last-mentioned compounds. These data also apply to the water-soluble salts of the monosulfates and/or disulfates of the poly-lower alkylene ether glycols used as viscosity regulators according to the invention.

In the second form of execution, the invention relates to a process for the improvement of the flow behavior of difficult-to-pour aqueous concentrates of tensides of the type mentioned previously in connection with the first form of execution of the invention. This process is characterized by the fact that water-soluble salts of monosulfates and/or disulfates of the poly-lower alkylene ether glycols with a molecular weight of at least 600, preferably of at least 1,000, are used as viscosity regulators. Again, the nonsulfated, free, poly-lower alkylene ether glycols with a molecular weight of at least 1,500 may be incorporated in the viscosity regulator, if desired.

The sulfates, and here particularly the disulfates, of poly-lower alkylene ether glycols, and particularly of polyethylene oxide and/or 1,2-polypropylene oxide, proved to be especially effective viscosity regulators even for highly concentrated aqueous concentrates of tensides of the type to which the present application is concerned. The effect of these regulators, that is, the reduction of the viscosity or the reduction of the thickening phase of the gel, increases with the rising molecular weight or the rising degree of polycondensation of the alkylene ether glycol.

The molecular weight of the basic material for the viscosity regulators is preferably at least about 1,000. Molecular weights of up to 6,000 or even greater may be considered in this case. Particularly preferred are disulfates of poly-lower alkylene ether glycols of the described type, with molecular weights in the range of from 1,500 to 4,000, or 1,500 to 3,000.

The disulfates used as viscosity regulators according to the invention thus normally are derived from polyether glycols, which differ from the polyalkylene glycols that can be formed, due to slight traces of water, during the alkoxylation of alcohol components. The teaching of the invention also can be applied to the use of the viscosity regulators in predeterminable types and amounts, so that predetermined, controlled effects with respect to the reduction of the gel phase are possible. The viscosity regulators used according to the invention are themselves effective wash-active substances (WAS). An undesirable loading with inactive components is thus avoided. The tenside mixtures according to the invention not only can be pumped in highly concentrated form, but no increase in the gel phase occurs upon dilution with water, and the desired diluting effect takes place instead.

A further advantage of the process of the invention when applied to the lowering of the viscosity of water-soluble salts of sulfates of nonaromatic alcohol alkoxylates is that, after the lowering of the tenside content to the low values of, for example, about 10% to 25% by weight, as is desirable in practice, the now easily movable, liquid, aqueous solutions can again be effectively thickened by the addition of neutral salts.

Any desired water-soluble salts of the viscosity regulators according to the invention can be used. Particularly suitable for practical application are the alkali metal salts, soluble alkaline earth metal salts, such as magnesium salt, the ammonium salts and/or salts with organic amines. Suitable organic amine salts are, for example, the alkylolamine salts. The sodium salts are especially preferred. The salt most important for practical application is the sodium salt of the disulfate of polyethylene ether glycols and/or 1,2-polypropylene ether glycols, with the respective, given minimum molecular weights. The salt-forming cations of the viscosity regulators can also be employed to derive the salt-forming cations contained in the tensides.

The viscosity regulators can be present in the aqueous concentrates of tensides in amounts of up to 20% by weight, preferably in amounts of 0.1% to 10% by weight. Especially preferred are amounts of from 2% to 5% by weight. These numerical data refer to the respective aqueous tenside concentrate. The amount of the viscosity regulator is determined individually by the desired lowering of the gelling point and/or the thickening effect of the respective tenside. The special structure of the tenside may have significance for the last point. When tensides of the mentioned type are present, which contain polyalkoxy groups, the degree of polyalkoxylation of the basic alcohol can be significant. Low alkoxlated alcohols usually can be effectively influenced by 2% to 5% by weight of the viscosity regulator, even when they are highly concentrated, while somewhat larger amounts of the viscosity regulator may become necessary when they are mixed with highly polyalkoxylated alcohols (degree of polymerization of the polyalkoxy radical about 10 to, e.g., 100).

As mentioned before, free polyethylene ether glycol and/or free polypropylene ether glycol may be used together with the sulfates of polyethylene ether glycol and/or polypropylene glycol, as part of the viscosity-regulating component, if desired. Here, too, it was observed that the effect of these nonsulfated poly-lower alkylene ether glycols are the more pronounced, the higher the molecular weight of the poly-lower alkylene ether glycol. These free poly-lower alkylene ether glycols, which may be optionally added, should have a molecular weight of at least 1,500, preferably their molecular weight is at least 2,000 and lies, for example, in the range from 2,000 to 6,000, especially in the range from 3,000 to 5,000.

The mixing ratio of the sulfates of the poly-lower alkylene ether glycols, particularly the disulfates, to the free poly-lower alkylene ether glycols is desirably in the range from 1:0 to 1:3. The mixing range from 1:0 to 1:1 is generally preferred.

The viscosity regulator, in the scope of the invention, can be added to the aqueous tenside concentrate in the form of a preformed compound or as a preformed mixture of compounds. The viscosity regulator is advantageously used as concentrated aqueous solution (WAS content, for example, from 50% to 90% by weight) and mixed with the aqueous solution of the respective tenside.

However, in a special form of execution it is possible in certain cases falling within the scope of the invention to prepare the viscosity regulator by sulfating the poly-lower alkylene ether glycols in situ in the presence of the tenside-forming basic components, when these are alcoholic. Sulfating may be carried out, for example, in the presence of an alkaryl polyglycol ether alcohol or in the presence of the nonaromatic alcohol alkoxylate. The sulfation of the alcoholic tenside-forming component as well as of the preformed poly-lower alkylene ether glycols is combined advantageously in this form of execution. Thus the desired mixing proportions of the tenside-forming alcoholic component(s) and the poly-lower alkylene ether glycols forming the viscosity regulator simply are adjusted, and this mixture of substances is then subjected to the well-known sulfation. Finally the formed acid sulfates are converted into the desired water-soluble salt. The same cation is used for the water-soluble salt of the tenside and the viscosity regulator in this process.

The data of the mentioned state of the art should be referred to for the specific chemical nature of the tenside component to be used within the scope of the invention. In the mentioned classes of substances, members of the following type are preferably used according to the invention:

I. Alkyl Ether Sulfates

The preferred tensides of this class have the following formula:

$$R—O(A—O)_pSO_3M$$

wherein R—O— represents the radical of a nonaromatic alcohol which may be straight-chain or branched-chain, saturated or unsaturated and usually contains from 8 to 24 carbon atoms, preferably from 10 to 18 carbon atoms, A represents lower alkylene which may be straight-chained and/or branched chained, p is an integer from 1 to 100 and M is the cation of a water-soluble salt, especially an alkali metal, water-soluble alkaline earth metal, ammonium or organic amine. The preferred cation is sodium.

Basically the above alkyl ether sulfates are derived from natural products as well as by synthesis. More particularly, they are derived from alkanols, alkenols, alkadienols and mixtures thereof.

The alcohols are alkoxylated with lower alkylene oxides in a first step. Here, a distinction may be made between the two large groups of the lower alkoxylated and higher alkoxylated derivatives. The lower alkoxylated derivatives have up to 10, preferably 1 to 4, and especially 2 to 3, alkoxy groups added to the alcohol radical. For the high alkoxylated derivatives, the number of polyalkoxy radicals exceeds 10, for example, to 100, especially from 20 to 80. The most important alkoxylating agents are ethylene oxide and/or 1,2-propylene oxide.

II. Alkaryl Polyglycol Ether Sulfates

The preferred tenside of this class can be characterized by the general formula:

$$R'_m—Ar—O(A—O)_nSO_3M$$

wherein R' represents an alkyl or alkenyl, which may be straight-chained or branched-chained. Preferred here are alkyl radicals with 4 to 16 carbon atoms, particularly with 6 to 14 carbon atoms. Alkyl radicals with 8 to 12 carbon atoms may be of special significance, m is 1, 2 or 3, 1 being preferred as a rule. Ar represents a phenylene or naphthylene, the phenylene being preferred here. A is a lower alkylene radical that may be straight-chained and/or branched-chained. The preferred lower alkylene radicals are ethylene and/or propylene-(1,2). n is an integer from 1 to 100. Here a distinction may be made between the two large groups of the lower alkoxylated and the higher alkoxylated derivatives. For the low alkoxylated derivatives up to 12, especially 2 to 10, alkoxy groups are added to the alcohol radical. In the higher alkoxylated derivatives, polyalkoxy radicals with a number exceeding 12, e.g., up to 100, especially 20 to 50, are provided. M is a cation of a soluble salt, especially alkali metal, water-soluble alkaline earth metal ammonium or organic amines. The specially preferred cation is sodium.

III. Alkyl Sulfates

The compounds correspond preferably to the formula:

$$R—O—SO_3M$$

wherein R—O— and M have the same significance as I above.

IV. Alkaryl Sulfonates

Tensides of this class correspond to the formula:

$$R'—Ar—SO_3M$$

wherein R' and Ar have the same significance as in II above and M has the same significance as in I above.

V. Alkyl Polyglycol Ether Sulfosuccinates

Tensides of this class correspond to the formula:

$$R—O(A—O)_nCO—CH_2—\overset{SO_3M}{\overset{|}{C}}H—CO—Z$$

The position of the $SO_3M$ group may vary within the succinic acid group. The significance of the elements in this representation of the formula is as follows: R, A and M have the same significance as in I above. n has the same significance as in II above. Z represents —OM or $(O—A)_nO—R$. In this last-mentioned case, the diesters of sulfosuccinic acid are present.

VI. Alkaryl Polyglycol Ether Sulfosuccinates

The compounds of this class correspond to the general formula:

$$R'_m—Ar—O(A—O)_nCO—CH_2—\overset{SO_3M}{\overset{|}{C}}H—CO—Z$$

The position of the sulfonic acid radical in the succinic acid may vary also in tensides of this type.

The symbols of this representation of the formula have the following significance:

R' = Same significance as in II,
m = Same significance as in II,
Ar = Same significance as in II,
A = Same significance as in I,
n = Same significance as in II,
Z = —OM or $(O—A)_nO—Ar—R_m$. In the latter case, the diester of sulfosuccinic acid is again present.
M = Same significance as in I.

VII. Alkyl Sulfosuccinates

Tensides of this class correspond to the general formula:

$$R—O—CO—CH_2—\overset{SO_3M}{\overset{|}{C}}H—CO—Z$$

Again, the position of the radical $SO_3M$ in the succinic acid radical may vary.

The symbols in this general formula have the following significance:

R = Same significance as in I,
Z = —OM or —OR (diester of sulfosuccinic acid),
M = Same significance as in I.

The aqueous tensides according to the invention also may contain other surfactants in addition to these anionic tensides. Suitable are, for example, nonionic surfactants, for example, alkylphenol polyglycol ethers.

Small amounts of inorganic salts, such as sodium chloride and/or sodium sulfate usually are contained in the aqueous concentrates of the invention, from the preparation of the alkyl and alkaryl ether sulfates as well as of the described sulfosuccinates and/or the viscosity regulators used according to the invention. The data of the state of the art describes this.

The following examples are illustrative of the invention without being limitative in any respect.

EXAMPLE 1

The viscosity-regulating properties of polyethylene glycol disulfate and 1,2-polypropylene glycol disulfate on aqueous 70% alkyl ether sulfate concentrates were determined in a series of comparison tests. The dependence of the viscosity-regulating activity on the most varied parameters was determined herein.

The products used in this Example have the following analytical data:

(1) Na C-12/14-fatty alcohol-2-EO-sulfate (abbreviated: C12/14-2-sulfate)
70.0% by weight WAS (portion soluble in ethanol)
0.4% by weight NaCl
0.9% by weight $Na_2SO_4$ (2) Na C-12/14-fatty alcohol-3EO-sulfate (abbreviated: C12/14-3-sulfate)
70.0% by weight WAS (portion soluble in ethanol)
0.4% by weight NaCl
0.9% by weight $Na_2SO_4$ (3) Polyethylene ether glycol disulfates based on polyethylene ether glycols with the molar weights of 600, 1,550, 2,000 and 3,000, respectively, obtained by direct sulfation with chlorosulfonic acid and present in the form of an aqueous solution of about 70% by weight.

(4) Polypropylene ether glycol disulfates based on polypropylene-1,2-ether diglycols with the molar weights of 620, 1,020 and 2,020, respectively, prepared also according to a conventional method by direct sulfation of the respective polypropylene ether glycols and present in the form of solutions of about 70% by weight in water.

A

The dependence of the viscosity (determined according to Höppler with the falling ball viscosimeter at 20° C.) on the molar weight of the polyethylene ether glycol disulfate used was established in an initial test series. The numerical values for the viscosity are recorded in mPas in the following Table 1 and in the other tables of this Example.

Na C-12/14-fatty alcohol-2-EO-sulfate was used as the tenside.

TABLE 1

| WAS % by Weight | Amount of PGS % by Weight | VISCOSITY No Additive | Molecular Weight of the Basic Polyethylene Ether Glycol 600 | 1,550 | 2,000 | 3,000 |
|---|---|---|---|---|---|---|
| 70 | 0 | 150,000 | | | | |
| | 3 | | 120,000 | 60,000 | 60,000 | 60,000 |
| | 4 | | | 80,000 | | |
| 65 | 0 | not measurable | | | | |
| | 2.8 | | | 50,000 | | |
| | 3.7 | | | 30,000 | | |

*PGS = Polyglycol disulfate

B

The dependence of the viscosity on the type of the basic alkyl ether sulfate, when polypropylene ether glycol disulfate (molar weight 1,550) is used, was determined in a second test series, and reported in Table 2.

TABLE 2

| WAS % by Weight | Amount of PGS* % by Weight | VISCOSITY C-12/14-2-Sulfate Without Additive | C-12/14-2-Sulfate With Additive | C-12/14-3-Sulfate Without Additive | C-12/14-3-Sulfate With Additive |
|---|---|---|---|---|---|
| 70 | 0 | 150,000 | | 180,000 | |
| | 3 | | 60,000 | | 35,000 |
| | 4 | | 80,000 | | 40,000 |
| 65 | 0 | not measurable | | not measurable | |
| | 2.8 | | 50,000 | | >150,000 |
| | 3.7 | | 30,000 | | 150,000 |

*PGS = Polyglycol sulfate

C

The dependence of the viscosity on the type of polyglycol or the corresponding water-soluble sulfate salts was determined in a third test series and reported in Table 3.

Tenside used: Na C-12/14-fatty alcohol-2-EO-sulfate
Polyglycol disulfate content: 2.8%
WAS: 65%

TABLE 3

| Additive | Viscosity (mPas) |
|---|---|
| Without additive | Not measurable |
| Polyethylene glycol-600-disulfate | 80,000 |
| Polyethylene glycol-1550-disulfate | 50,000 |
| Polyethylene glycol-3000-disulfate | 40,000 |
| Polypropylene glycol-620-disulfate | 90,000 |
| Polypropylene glycol-1020-disulfate | 40,000 |
| Polypropylene glycol-2020-disulfate | 40,000 |

D

The rethickening property of the alkyl ether sulfate solutions liquefied by the addition of water was determined in a final test series. C-12/14-2-sulfate was liquefied with 3% by weight or 6% by weight of the viscosity regulator and, after dilution with water to a content of 10% by weight WAS, the solution was tested for its ability to thicken again with addition of table salt. The results obtained according to the invention are compared with corresponding solutions that contain butoxyethyl sulfate or cumene sulfonate as viscosity regulator, in Table 4.

TABLE 4

| NaCl % | Without Additive Addition | Polyethylene glycol-1550-sulfate 3% | 6% | Butoxyethyl Sulfate 3% | 6% | Cumeme Sulfonate 3% | 6% |
|---|---|---|---|---|---|---|---|
| 3 | 47 | 47 | 29 | 33 | 26 | 14 | 14 |
| 5 | 5470 | 5440 | 6200 | 4030 | 1490 | 670 | 670 |
| 7 | 28170 | 20500 | 22600 | 18290 | 12380 | 9520 | 28200 |
| 9 | 14780 | 5230 | 5200 | 8800 | 8900 | 9640 | 9600 |

Tables 1 and 2 show that even small quantities of the viscosity regulators according to the invention have a liquefying effect on highly concentrated sulfates of fatty alcohol ethers. On changing to lower concentrations, that is, on diluting, the viscosity does not increase abruptly, instead a reduction occurs.

The ability of the dilute tenside solutions to thicken again is less impaired than that of the solutions employing the short-chain alkyl ether sulfates (butoxyethyl sulfate). This holds true to an increased degree in comparison with the use of cumene sulfonate.

EXAMPLE 2

The aqueous solution of an Na C-12/14-fatty alcohol-50-EO-sulfate with a WAS content of 25% by weight has a gelling point of +12° C. Disodium polyethylene ether glycol disulfates based on polyethylene ether glycols with the molar weights of 1,550, 3,000 and 4,000, respectively, were used to lower the gelling point. The gelling point of the starting solution was lowered to the values recorded in Table 5 by the addition of 1.2 parts by weight of disodium polyethylene ether glycol disulfate per 100 parts by weight of the fatty alcohol-EO-sulfate.

TABLE 5

| Addition | Gelling Point °C. |
|---|---|
| Without addition | +12 |
| Polyethylene glycol-1550-disulfate | +2 |
| Polyethylene glycol-3000-disulfate | −1 |
| Polyethylene glycol-4000-disulfate | −3 |

This test series shows that even the small addition of 1.2% by weight, based on the fatty alcohol-EO-sulfate, causes a lowering of the gelling point in the order of a magnitude of 10° C.

EXAMPLE 3

An adduct of 50 mols of ethylene oxide with one mol of a C-12/14-fatty alcohol was sulfated alone and in admixture with polyethylene ether glycol, with chlorosulfonic acid, in the ratios for polyethylene ether glycol given in Table 6 and under the usual conditions. Here, 1.05 mols of chlorosulfonic acid were used per mol of hydroxyl groups (calculation based on the OH-number). After neutralizing with sodium hydroxide solution and adjusting to a concentration of active substance of 25% by weight, the gelling points recorded in Table 6 were found.

TABLE 6

| Starting Material | OH-Number | Gelling Point °C. |
|---|---|---|
| C-12/14-fatty alcohol + 50 EO | 25 | +12 |
| 100 parts/wt C-12/14-fatty alcohol + 50 EO<br>3.9 parts/wt polyethylene ether glycol 4000 | 29 | −3 |
| 100 parts/wt. C-12/14-fatty alcohol + 50 EO<br>1.3 parts/wt. polyethylene ether glycol 1550<br>2.6 parts/wt. polyethylene ether glycol 5000-6000 | 29 | −2 |

EXAMPLE 4

The viscosity-regulating influence of the polyethylene glycol disulfate on alcohol-free aqueous 70% concentrates of alkaryl ether sulfates was determined in this example.

The viscosities of the following were determined according to Hoppler at 50° C.:

A. Nonylphenol+4 EO-sulfate, $NH_4$+-salt
Prepared according to U.S. Pat. No. 2,758,977.

B. Mixtures of A with:

(1) Commercial polyethylene ether glycols (PEG) with mean molar weights of 600, 1,550, 3,000 and 4,000.

(2) Polyethylene ether glycol mono/disulfates based on polyethylene ether glycols with the molar weights of 600, 1,550, 3,000 and 4,000, obtained by direct sulfation with chlorosulfonic acid and the in the form of about 35% by weight aqueous solutions.

(3) Polyethylene ether glycol-4000-mono/disulfate, prepared in situ, by the sulfation of a mixture of nonylphenol+4 EO and polyethylene ether glycol 4000.

The results are summarized in Table 7.

TABLE 7

| | Viscosity (mPas)/50° C. |
|---|---|
| Product A | Not measurable |
| Mixtures according to B(1) | |
| with 5% PEG 600 | Not Measurable |
| with 10% PEG 600 | " |
| with 5% PEG 1550 | " |
| with 10% PEG 1500 | " |
| with 5% PEG 3000 | " |
| with 10% PEG 3000 | " |
| with 5% PEG 4000 | 32,000 |
| with 10% PEG 4000 | 21,000 |
| Mixtures according to B(2) | |
| with 5% PEG 600 mono/disulfate | Not measurable |
| with 10% PEG 600 mono/disulfate | " |
| with 5% PEG 1550 mono/disulfate | 22,000 |
| with 10% PEG 1550 mono/disulfate | 9,000 |
| with 5% PEG 3000 mono/disulfate | 15,000 |
| with 10% PEG 3000 mono/disulfate | 6,500 |
| with 5% PEG 4000 mono/disulfate | 10,000 |
| with 10% PEG 4000 mono/disulfate | 4,000 |
| Mixtures according to B(3) | |
| with 5% PEG 4000 mono/disulfate | 2,000 |
| with 10% PEG 4000 mono/disulfate | 500 |

EXAMPLE 5

The use of polyglycols or polyglycol disulfates for the purpose of lowering the gelling point of a highly ethoxylated alkylphenol ether sulfate was investigated in this example and shown in Table 8. The aqueous solution of a dodecylphenol+40 EO-sulfate, Na-salt, with a content of 30% by weight of active substance has a gelling point of +12.5° C. The following were used to lower the gelling point:

(a) Polyethylene ether glycols (PEG) with the mean molar weight of 4,000, (b) Polyethylene ether glycol mono/disulfates based on a polyethylene ether glycol with a mean molar weight of 4,000.

TABLE 8

| Addition | Gelling Point °C. |
|---|---|
| Without addition | +12.5 |
| 1.5%/wt. PEG 4,000 (100%) | +11 |
| 3%/wt. PEG 4,000 (100%) | +9 |
| 5%/wt. PEG 4,000 (100%) | +6 |
| 1.5%/wt. PEG 4,000 mono/disulfate Na-salt, about 30% in water | +4 |
| 3%/wt. PEG 4,000 mono/disulfate Na-salt, about 30% in water | 0 |
| 5%/wt. PEG 4,000 mono/disulfate Na-salt, about 30% in water | −5 |

EXAMPLE 6

The viscosity of a 30% $C_{12}/C_{15}$-oxoalcohol sulfate Na-salt (abbreviated as OAS) according to Hoppler at 25° C. is approximately 8,500 mPas. The viscosity lowering effect of PEG-disulfates on such aqueous alkyl sulfate concentrates was determined in this example and given in Table 9. The following mixtures of OAS were prepared for this purpose, and the Hoppler viscosity was measured.

TABLE 9

| Mixture | Hoppler Viscosity at 25° C./mPas |
|---|---|
| 100 parts by weight OAS | 8,500 |
| 97.5 parts/wt. OAS + 2.5 parts/wt. PEG 4000 (30% in water) | 2,400 |
| 95 parts/wt. OAS + 5 p./wt. PEG 4000 (30% in water) | 1,080 |
| 90 parts/wt. OAS + 10 p./wt. PEG 4000 (30% in water) | 550 |
| 97.5 parts/wt. OAS + 2.5 p./wt. PEG 4000-disulfate Na-salt (30% in water) | 640 |
| 95 parts/wt. OAS + 5 p./wt. PEG 4000-disulfate Na-salt (30% in water) | 340 |
| 90 parts/wt. OAS + 10 p./wt. PEG 4000-disulfate Na-salt (30% in water) | 160 |

EXAMPLE 7

A 50% n-dodecylbenzene sulfonate (here called ABS, commercially available as Maranil ® paste A 50) forms a highly viscous, viscid, unpourable paste, and its Hoppler viscosity cannot be measured. The Brookfield viscosity (spindle 6, 20 rpm, 25° C.) is 23,000 mPas. The viscosity lowering effect of polyethylene ether glycols and of PEG-disulfates on such aqueous ABS concentrates was determined in this example. The following mixtures of ABS were prepared for this purpose and the Hoppler viscosity was measured and reported in Table 10.

TABLE 10

| Mixture | Hoppler Viscosity at 25° C./mPas |
|---|---|
| 100 parts by weight ABS | Not measurable |
| 97.5 p./wt. ABS + 2.5 p./wt. PEG 4000 (100%) | Not measurable |
| 97.5 p./wt. ABS + 2.5 p./wt. PEG 4000-disulfate, Na-salt (30%) | Not measurable |
| 95 p./wt. ABS + 5 p./wt. PEG 4000 (100%) | Not measurable |
| 95 p./wt. ABS + 5 p./wt. PEG 4000-disulfate, Na-salt (30%) | About 11,000 |
| 90 p./wt. ABS + 10 p./wt. PEG 4000 (100%) | Not measurable |
| 90 p./wt. ABS + 10 p./wt. PEG 4000-disulfate, Na-salt (30%) | About 900 |
| 85 p./wt. ABS + 15 p./wt. PEG 4000 (100%) | About 13,000 |
| 85 p./wt. ABS + 15 p./wt PEG 4000-disulfate, Na-salt (30%) | About 750 |

EXAMPLE 8

The use of polyglycol disulfates to lower the gelling point of semiesters of sulfosuccinic acid is examined in this example.

The di-Na-sulfosuccinic acid semiester of octylphenol+11 EO forms a nonpourable, immovable gel even at a low 30% AS in aqueous solution, which becomes viscous only at 33° C. (gelling point). The Hoppler viscosity of the gel at 25° C. naturally is too high to measure. The gelling point can be lowered to −2° C. by the small addition of 5% PEG 4000-disulfate, Na-salt, as a 33% aqueous solution, and the Hoppler viscosity at 25° C. is measurable with a low 80–100 mPas. The addition of 10% PEG 4000-disulfate, Na-salt, as a 33% aqueous solution lowers the gelling point still further to $<-10°$ C.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An aqueous concentrate of a tenside containing (1) from 20% to 80% by weight of a water-soluble salt of a nonaromatic alcohol poly-lower alkylene ether glycol sulfate having the formula:

$$R—O(A—O)_pSO_3M$$

wherein R is a radical having from 8 to 24 carbon atoms selected from the group consisting of alkyl, alkenyl, alkadienyl and mixtures thereof, A is selected from the group consisting of ethylene and propylene-1,2, p is an integer from 1 to 100 and M is a water-soluble cation selected from the group consisting of alkali metals, water-soluble alkaline earth metals, ammonium, and organic amine, and (2) a viscosity reducing amount of from 0.1% to 10% by weight of a water-soluble salt of a polyglycol ether sulfate selected from the group consisting of monosulfates of poly-lower alkylene ether glycols having a molecular weight of from 1500 to 6000, disulfates of poly-lower alkylene ether glycols having a molecular weight of from 1500 to 6000 and mixtures thereof and (3) from 0 to a viscosity reducing amount of a poly-lower alkylene ether glycol having a molecular weight of at least 1,500, said lower alkylene groups in said polyglycol ether sulfate being selected from the group consisting of ethylene and propylene-1,2.

2. The aqueous concentrate of claim 1 wherein the molecular weight of said poly-lower alkylene ether glycols forming said sulfate is between 1,500 and 4,000.

3. The aqueous concentrate of claim 1 wherein said water-soluble salt of a polyglycol ether sulfate is a cation selected from the group consisting of alkali metal, water-soluble alkaline earth metal, ammonium and organic amine.

4. The aqueous concentrate of claim 7 wherein said water-soluble salt of a polyglycol ether sulfate is present in an amount of from 2% to 5% by weight.

5. The aqueous concentrate of claim 1 containing additional nonionic tensides.

6. The aqueous concentrate of claim 5 wherein said additional nonionic tensides are alkoxylated alkylphenols.

7. In the process for improving the flow behavior of difficultly pourable aqueous concentrates of tensides of the sulfate and sulfonate type containing at least about 20% by weight of a water-soluble salt of at least one anionic tenside selected from the group consisting of alkyl polyalkylene ether glycol sulfates, alkaryl polyalkylene ether glycol sulfates, alkyl polyalkylene ether glycol sulfosuccinates, alkaryl polyalkylene ether glycol sulfosuccinates, alkyl sulfates, alkaryl sulfonates and alkyl sulfosuccinates by mixing therewith a viscosity reducing amount of an organic viscosity reducing compound and recovering an aqueous concentrate having improved flow behavior, the improvement consisting essentially of utilizing a viscosity reducing amount of from 0.1% to 10% by weight of a water-soluble salt of a polyglycol ether sulfate selected from the group consisting of monosulfates of poly-lower alkylene ether glycols having a molecular weight of at least 600, disulfates of poly-lower alkylene ether glycols having a molecular weight of at least 600 and mixtures thereof and from 0 to a viscosity reducing amount of a poly-lower alkylene ether glycol having a molecular weight of at least 1,500, where the lower alkylene groups in said polyglycol ether sulfate are selected from the group consisting of ethylene and propylene-1,2, as said organic viscosity reducing compound.

8. The process of claim 7 wherein said viscosity reducing amount of said sulfate is from 2% to 5% by weight.

9. The process of claim 7 wherein said 0.1% to 10% of said sulfate or said sulfate and glycol is added to said aqueous concentrate as an aqueous concentrate.

10. The process of claim 7 wherein said anionic tenside is selected from the sulfates and the precursor of said anionic sulfate tenside and the precursor of said polyglycol ether sulfate are mixed simultaneously, sulfonated and neutralized to form said water-soluble salts.

11. The process of claim 7 or 8 or 9 or 10 wherein the molecular weight of said poly-lower alkylene ether glycols forming said sulfate is at least 1,000.

12. The process of claim 7 or 8 or 9 or 10 wherein the molecular weight of said poly-lower alkylene ether glycols forming said sulfate is between 1,500 and 6,000.

13. The process of claim 7 or 8 or 9 or 10 wherein the molecular weight of said poly-lower alkylene ether glycols forming said sulfate is between 1,500 and 4,000.

14. The process of claim 7 or 8 or 9 wherein said water-soluble salt of a polyglycol ether sulfate is a cation selected from the group consisting of alkali metal, water-soluble alkaline earth metal, ammonium and organic amine.

15. The process of claim 7 or 8 or 9 wherein said water-soluble salt of an anionic tenside is a water-soluble salt of a nonaromatic alcohol poly-lower alkylene ether glycol sulfate having the formula:

$$R—O(A—O)_pSO_3M$$

wherein R is a radical having from 8 to 24 carbon atoms selected from the group consisting of alkyl, alkenyl, alkadienyl and mixtures thereof, A is selected from the group consisting of ethylene and propylene-1,2, p is an integer from 1 to 100 and M is a water-soluble cation selected from the group consisting of alkali metals, water-soluble alkaline earth metals, ammonium, and organic amine.

16. The process of claim 7 or 8 or 9 wherein said aqueous concentrates of tensides of the sulfate and sulfonate type contain additional nonionic tensides.

17. The process of claim 7 or 8 or 9 wherein said aqueous concentrates of tensides of the sulfate and sulfonate type contain nonionic alkoxylated alkylphenols as an additional nonionic tenside.

* * * * *